US008360748B2

(12) United States Patent
Arnold

(10) Patent No.: US 8,360,748 B2
(45) Date of Patent: Jan. 29, 2013

(54) ROTARY PISTON MACHINE

(75) Inventor: Felix Arnold, Neckarsteinach (DE)

(73) Assignees: Cor Pumps + Compressors AG, Stuttgart (DE); Robert Bosch GmbH, Stuttgart (DE)

( * ) Notice: Subject to any disclaimer, the term of this patent is extended or adjusted under 35 U.S.C. 154(b) by 1007 days.

(21) Appl. No.: 12/227,044

(22) PCT Filed: May 10, 2007

(86) PCT No.: PCT/DE2007/000861

§ 371 (c)(1),
(2), (4) Date: Jan. 26, 2009

(87) PCT Pub. No.: WO2007/128303

PCT Pub. Date: Nov. 15, 2007

(65) Prior Publication Data

US 2010/0034680 A1 Feb. 11, 2010

(30) Foreign Application Priority Data

May 10, 2006 (DE) ..... 10 2006 022 025

(51) Int. Cl.
*F04B 17/03* (2006.01)
*F01C 1/08* (2006.01)

(52) U.S. Cl. ..... 417/360; 417/410.4

(58) Field of Classification Search ..... 417/410.4; 418/68, 195

See application file for complete search history.

(56) References Cited

U.S. PATENT DOCUMENTS

| | | | | |
|---|---|---|---|---|
| 3,572,982 | A | 3/1971 | Kozdon | |
| 3,710,156 | A * | 1/1973 | Laing | 310/54 |
| 4,930,997 | A | 6/1990 | Bennett | |
| 5,791,888 | A | 8/1998 | Smith | |
| 6,361,289 | B1 * | 3/2002 | Hennes et al. | 417/310 |
| 6,896,494 | B2 | 5/2005 | Sunaga et al. | |
| 7,275,920 | B2 | 10/2007 | Arnold | |
| 7,390,181 | B2 * | 6/2008 | Arnold | 418/195 |
| 2002/0192099 | A1 | 12/2002 | Patsch et al. | |
| 2003/0129068 | A1 * | 7/2003 | Oehman, Jr. | 417/360 |
| 2004/0037719 | A1 | 2/2004 | Sunaga et al. | |
| 2005/0175493 | A1 | 8/2005 | Arnold | |
| 2007/0259199 | A1 | 11/2007 | Arnhold et al. | |

FOREIGN PATENT DOCUMENTS

| | | | |
|---|---|---|---|
| AT | 281184 | | 5/1970 |
| DE | 1 011 896 | | 7/1957 |
| DE | 197 25 462 | | 12/1998 |
| DE | 199 16 876 | | 11/2000 |
| DE | 199 62 804 | | 7/2001 |
| DE | 103 21 521 | | 6/2004 |
| DE | 603 00 780 | | 11/2005 |
| EP | 1 335 135 | | 8/2003 |
| GB | 2 402 975 | | 12/2004 |
| JP | 2000-303967 | | 10/2000 |
| WO | WO-2004/015245 | | 2/2004 |
| WO | WO-2005/024236 | | 3/2005 |
| WO | WO2005/024237 | * | 3/2005 |

* cited by examiner

*Primary Examiner* — Charles Freay

(74) *Attorney, Agent, or Firm* — Jordan and Hamburg LLP

(57) ABSTRACT

An electrically driven rotary piston machine which operates as a rotary piston pump or rotary piston compressor wherein the rotary piston machine has a basic housing, which holds an electrical coil and pump head, wherein the pump working space is preferably bounded by a trochoid toothing of the rotors. The pump head which can usually be manufactured relatively economically is embodied as a disposable part and therefore has a quick-action connection with the more complex basic housing.

10 Claims, 1 Drawing Sheet

ROTARY PISTON MACHINE

BACKGROUND OF THE INVENTION

Prior Art

The invention is based on a method on a rotary piston machine, and on a method for manufacturing same, and on a rotary piston machine for carrying out the method.

A considerable problem in the generic field of pumps and compressors occurs whenever the materials to be fed are poisonous materials which are also viscous or can only be fed at high temperatures, which makes stringent requirements of the cleaning of the rotating parts, or makes said cleaning difficult overall or even impossible. In addition, there are decision problems when comparing the values of the materials to be fed with the value of the machine and possibly replacing same. This applies, in particular, when the machine is used for pharmaceutical materials but also for certain plastics which usually have to be fed at a high temperature. A considerable problem is the cleaning of the pump parts. This also consists in the fact that when cleaning acids or the like are used the pump parts have to be correspondingly resistant. The remaining residual spaces of the pump, i.e. the damaging spaces, should also be kept as small as possible for this purpose and should, if possible, tend toward zero. In practice, attempts are made to counteract this problem by using stainless steel or expensive resistant materials for the rotary piston machines.

The object on which the invention is based in a rotary piston machine of the generic type is to develop a deployment method or manufacturing method, or a special design by means of which such a rotary piston machine can be made available to a wide range of use, in particular while overcoming the prejudices of the specialists.

It is known per se for the usually fixedly arranged, complex housing part which accommodates the electrically controlled coil and through which current flows in an electrically driven pump to be separated by means of a cup-shaped can from the rotating power rotor which accommodates the permanent magnet (DE 603 00 780 T2 and AT 28 11 84), but said document is concerned with a completely different problem, specifically with the cooling of electrical parts of such can pumps and not, as is the case in the invention, with a cost-saving configuration by combining an "inexpensive" pump head which is provided as a disposable part with a complex pump housing, which is under certain circumstances locationally fixed. The important thing for the invention is that after the pump head is released from the basic housing, the working spaces through which the medium which is to be fed flows are closed off on the side facing the basic housing so that, for example, acids and the like can remain in the disposable part and can be disposed of with it. In the known can motors (DE 603 00 780 D2 and AT 28 11 84), only the split cup dips into the electrically controlled winding when the pump is in the closed state, but the housing which holds the current coil does not form basic housing so that when the part which holds the coil through which electricity flows is moved the pump head is no longer closed with respect to the media to be fed.

It is also known to make the pump unit and motor or the operative connection between the motor and pump releasable in a medical metering pump for liquid medicines, in order, in so far as the pump is concerned, to thereby obtain a disposable unit which can be disconnected from the expensive drive unit (electric motor) so that the latter can be re-used (DE 199 16 876 A1). However, the pump here is a hose pump in which the feature according to which the pump head is embodied as a disposable part can already be found, but said hose pump does not have a quick-action connection apart from the fact that, of course, such pumps which are sealed off from the outside only by the feed hose have a very narrow range of use, and said pump is to be assigned to a different generic type of pumps with respect to the invention.

According to one advantageous refinement of the invention, the rotors have a trochoidal toothing (cycloidal toothing), said toothings engaging one in the other. Although such a rotary piston machine is known (see generic type WO 05/024 236 A1) with the large advantage that the remaining residual spaces of the pump, i.e. the damaging spaces are very small, there is, with respect to the invention, a considerable prejudice among specialists in such trochoidal rotary piston machines, in particular with respect to methods of use, manufacturing methods or design.

Only a very small number of known rotary piston machines meet the requirement for a damaging space which tends towards zero, which is very difficult to achieve (DE AS 10 11 896, NSU; WO 2005/024236 A1, COR), and they meet this requirement by virtue of the fact that the teeth of the rotating parts are embodied in cycloidal or trochoidal form and engage in the teeth of the other rotating part in a seal-forming fashion without additional sealing means by virtue of rounding of the teeth. In these known rotary piston machines, the damaging space can therefore be reduced to zero.

Although such a rotary piston machine with a rotor which is embodied in a trochoidal form has the advantage of a small damaging space, it does therefore not yet solve the above-mentioned problem, in particular when materials are fed at high temperatures (plastics) or aggressive materials are fed.

However, the trochoidal toothing is, in contrast to the known pumps, a complex precision pump whose configuration as a disposable part is unusual for a person skilled in the art so that prejudice on the part of specialists had to be overcome here.

The solution which arises from the problem on which the invention is based, specifically for the pump head which is composed of trochoidal parts to be embodied as disposable part and for said disposable part therefore to be connected to the basic housing with a quick-action connection, is unusual for a person skilled in the art, while quick-action connections between the motor and specific pumps of a wide variety of types are known, as is mentioned above.

A rotary piston machine, according to one aspect of the invention has a can embodied in the form of a cup in order to facilitate replacement of the pump head constitutes an additional intellectual step which is unusual because the pump head through which the substrate to be fed flows does not form, by virtue of its replaceability according to the invention, a connection, in terms of ideas, to the function of the known canned motor since for a person skilled in the art of the known pumps the can is intended to separate hermetically the flowing medium from the electrical part of the pump part during operation.

According to one advantageous refinement of the invention, when the pump head is replaced as a disposable part, the can with rotors and permanent magnet is therefore pulled out of the basic housing, after which the replacement part is then inserted. In order to facilitate the inventive replacement of the pump head, according to one refinement of the invention the connection between the basic housing and the pump head is embodied as a quick-action coupling which acts on corresponding devices of the basic housing and pump head.

An advantageous refinement of the invention in this respect is such that the device for connecting the housings of basic housing and pump head are located on the end faces which are in contact between basic housing and pump head, that the housings in the region which is in contact have an outer bead or flange, which are assigned to one another, and that the housings can be clamped together axially by means of a ring which engages over these beads or flanges and can be shortened tangentially.

One refinement of the invention consists in a manufacturing method in which these plastic parts of the pump head and/or of the split cup are manufactured ready-from-the mold. Such a method of manufacture can be used particularly advantageously in the trochoidally toothed rotors in which rounded teeth run on smooth faces with positive engagement, bounding a linear working space, between the edges and tooth tines of the teeth lying opposite one another, which is at odds with ready-from-the mold manufacture including the housing parts of the pump head and split cup.

Further advantages and advantageous refinements of the invention can be found in the following description, the claims and the drawings.

An exemplary embodiment of the subject matter of the invention is illustrated in the drawings.

DESCRIPTION OF THE PREFERRED EMBODIMENTS

Figure 1:
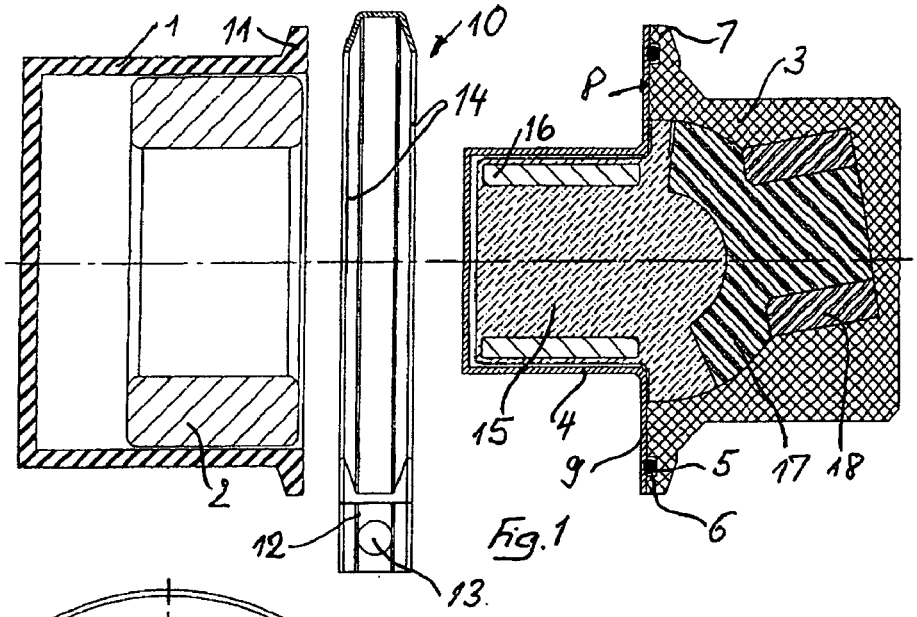
FIG. 1 shows an inventive rotary piston pump in an exploded illustration and in longitudinal section.

As is shown in the exploded illustration in FIG. 1, the rotary piston pump according to the invention has a basic housing 1 to which the pump can be anchored in a correspondingly locationally fixed fashion and in which the electrically controllable coil 2 of an electric motor is arranged. In the right hand part of the exploded illustration, a pump head 3 is illustrated which can be closed off by a can 4 in the form of a cup. An annular seal 5 is arranged in an end annular groove 6 in the pump head 3 between a flange-shaped section 9 of the can 4 and a flat end face of the pump head 3 which faces the section 9 of the can 4. The pump head 3 has, for this purpose, an annular bead 7 on which the end face 8 is present and which serves to engage a clamping ring 10 which engages, at the other end, on an annular bead 11 of the basic housing 1.

The clamping ring 10 is open on one side, indicated by 12, and its circumference can be shortened by a screw which can be inserted tangentially into an opening 13. The clamping ring 10 also has conically extending webs 14 so that shortening of the circumference of the clamping ring 10 and its engagement on the annular beads 7 and 11 of the pump head 3 and basic housing 1 causes them to be clamped together. The pump head 3 accommodates a power rotor 15 with a permanent magnet 16 in a section of the can 4 which is in the form of a cup, and a corresponding rotor 17 which is driven by the power rotor 15, by the rotary bearing 18 of said corresponding rotor 17.

Figure 2:
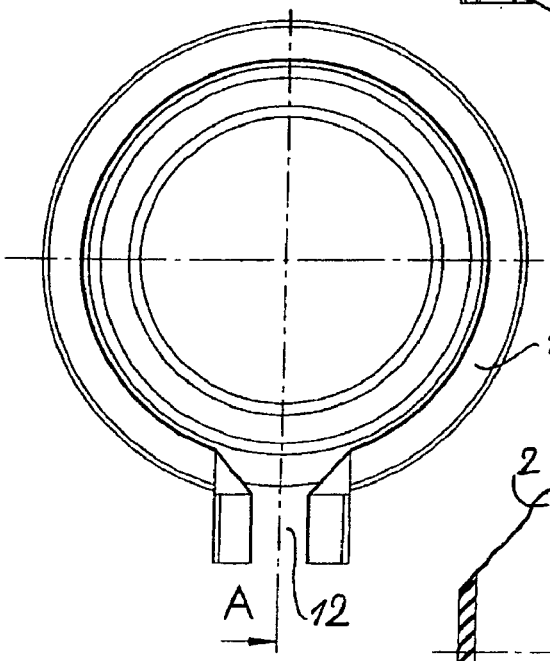
FIG. 2 shows the quick-action connection between the basic housing and the pump head housing in a plan view.

FIG. 2 illustrates, in particular, the clamping ring 10 with its open side 12.

Figure 3:
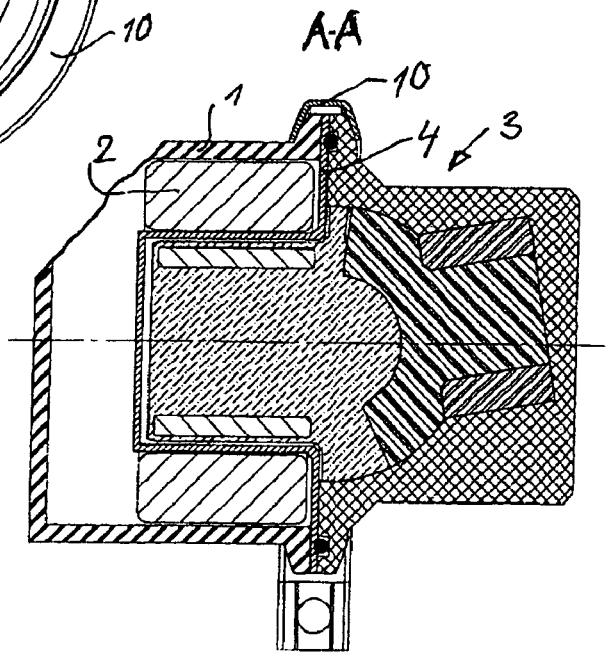
FIG. 3 shows the rotary piston pump corresponding to the section A from FIG. 2 in the assembled state.

In the version shown in the assembled state and in longitudinal section in FIG. 3 it is particularly clear that after the clamping ring 10 has been released, the pump head 3, including the can 4 which is to be separated off from the region through which the medium to be fed flows can easily be pulled out of the basic housing 1 and of the electrical coil 2. It is to be noted that the invention is not only restricted to canned machines but also includes rotary piston machines in which the seal between the pump head which is to be replaced and the basic housing is formed by other known means. The easy and practical replaceability of the pump head with separation of the flow medium is decisive.

All the features illustrated in the description, the following claims and the drawing can be essential to the invention either individually or in any desired combination with each other.

LIST OF REFERENCE NUMBERS

1 Basic housing
2 Coil
3 Pump head
4 Can
5 Annular seal
6 End annular groove
7 Annular bead of 3
8 End face
9 Flange section
10 Clamping ring
11 Annular bead of 1
12 Open side of 10
13 Opening
14 Webs
15 Power rotor
16 Permanent magnet
17 Corresponding rotor
18 Rotary bearing

The invention claimed is:

1. A rotary piston machine which operates as a pump or a compressor, comprising:

a pump drive device defining a can motor with a can and a power rotor which is toothed with a driven trochoid, a corresponding rotor which engages in the toothing and as a result is correspondingly toothed, a working space which is arranged between the rotors, a basic housing which holds parts for controlling the pump drive device, a pump head which supports the rotors axially and radially, and a releasable connecting device between the basic housing and the pump head, wherein the can includes a radially extending section between sides of the basic housing and pump head which face one another, wherein the pump drive device is divided by the can into a magnet part which is arranged in the power rotor and into a coil part which is arranged in the basic housing and through which current flows, wherein the can has a cup shape section that functions as a bearing for the power rotor and the can has a broad flange which is radially clamped in between the basic housing and the pump head; and wherein the power rotor has a bearing section arranged within the cup shape section of the can and has a permanent magnet.

2. The rotary piston machine according to claim 1, wherein the connection between the basic housing and the pump head comprises a quick-action coupling, which engages the basic housing and the pump head.

3. The rotary piston machine according to claim 2, wherein the quick-action coupling for connecting the basic housing and pump head is located in regions of end faces of the basic housing and the pump head which are in contact, and these end faces are clamped together axially by means of a ring comprising the quick-action coupling which engages over them and can be shortened tangentially.

4. The rotary piston machine according to claim 3, wherein the ring is a clamping ring which is curved outward in section and is open in the circumference at a location, having radial webs which are arranged at the open location and are connected to one another by means of a screw connection.

5. The rotary piston machine according to claim 1, wherein a seal is arranged between the end faces of the can and of the pump head which face one another.

6. The rotary piston machine according to claim 5, wherein the seal is arranged in an end ring groove and is embodied as a ring, and wherein the end ring groove is arranged on the side of the pump head facing the flange in order to close the entire pump head after disassembly.

7. The rotary piston according to claim 1, wherein the coil part and the permanent magnet are radially disposed relative to one another.

8. A rotary piston which operates as a pump or a compressor comprising:

a pump drive device defining a can motor with a can and a power rotor which is toothed with a driven trochoid, a corresponding rotor which engages in the toothing and as a result is correspondingly toothed, a working space which is arranged between the rotors, a basic housing which holds parts for controlling the pump drive device, a pump head which supports the rotors axially and radially, and a releasable connecting device between the basic housing and the pump head, wherein the can includes a radially extending section between sides of the basic housing and pump head which face one another, wherein the pump drive device is divided by the can into a magnet part which is arranged in the power rotor and toothings engaging one another, wherein the can has a cup shape section that functions as a bearing for the power rotor and the can has a broad flange which is radially clamped in between the basic housing and the pump head; and wherein the power rotor has a bearing section arranged within the cup shape section of the can and has a permanent magnet.

9. The rotary piston according to claim 8, wherein at least the power rotor and the corresponding rotor are made of plastic.

10. The rotary piston according to claim 8, wherein at least the parts of the pump head which come into contact with the materials to be fed while the machine is operating are made of plastic.

* * * * *